US008468952B2

(12) United States Patent
Worden et al.

(10) Patent No.: US 8,468,952 B2
(45) Date of Patent: Jun. 25, 2013

(54) DYNAMIC WEIGHT MANAGEMENT FOR A VEHICLE VIA HYDRAULIC ACTUATORS

(75) Inventors: Bret Worden, Erie, PA (US); Ajith Kuttannair Kumar, Erie, PA (US); Michael Marley, Erie, PA (US); Amit Iyer, Erie, PA (US); Adrian Gorski, Erie, PA (US)

(73) Assignee: General Electric Company, Schenectady, NY (US)

( * ) Notice: Subject to any disclaimer, the term of this patent is extended or adjusted under 35 U.S.C. 154(b) by 224 days.

(21) Appl. No.: 12/982,960

(22) Filed: Dec. 31, 2010

(65) Prior Publication Data

US 2012/0167797 A1 Jul. 5, 2012

(51) Int. Cl.
*B61F 1/00* (2006.01)

(52) U.S. Cl.
USPC ..... 105/209; 105/157.1; 105/199.5

(58) Field of Classification Search
USPC ..... 105/218.1, 219, 220, 224.05, 224.06
See application file for complete search history.

(56) References Cited

U.S. PATENT DOCUMENTS

| | | | | |
|---|---|---|---|---|
| 598,403 | A | 2/1898 | Uebelacker | |
| 1,020,607 | A | 3/1912 | Hunt | |
| 2,393,722 | A * | 1/1946 | Travilla, Jr. | 105/195 |
| 3,682,103 | A * | 8/1972 | Schwam | 105/199.2 |
| 4,186,914 | A | 2/1980 | Radwill et al. | |
| 4,337,706 | A * | 7/1982 | Loosli | 105/184 |
| 4,679,506 | A * | 7/1987 | Goding et al. | 105/136 |
| 5,001,989 | A * | 3/1991 | Mulcahy et al. | 105/199.5 |
| 5,524,551 | A | 6/1996 | Hawthorne et al. | |
| 7,285,926 | B2 | 10/2007 | McGarry et al. | |
| 7,349,797 | B2 | 3/2008 | Donnelly et al. | |
| 7,448,329 | B2 * | 11/2008 | Muller et al. | 105/224.05 |
| 7,954,436 | B2 * | 6/2011 | Gorski et al. | 105/218.1 |
| 2006/0230976 | A1 * | 10/2006 | Muller et al. | 105/224.05 |
| 2009/0031915 | A1 | 2/2009 | Kumar et al. | |
| 2009/0031916 | A1 | 2/2009 | Kumar et al. | |
| 2009/0031917 | A1 * | 2/2009 | Kumar et al. | 105/35 |
| 2009/0095196 | A1 * | 4/2009 | Kumar et al. | 105/96 |

(Continued)

FOREIGN PATENT DOCUMENTS

| | | |
|---|---|---|
| DE | 1035681 | 8/1958 |
| EP | 0779194 | 6/1997 |

(Continued)

OTHER PUBLICATIONS

Kumar; Ajith K. et al., "Vehicle Suspension Control System and Method," U.S. Appl. No. 12/574,914, filed Oct. 7, 2009, 52 pages.

(Continued)

*Primary Examiner* — Jason C Smith
(74) *Attorney, Agent, or Firm* — John A. Kramer; GE Global Patent Operation

(57) ABSTRACT

Methods and system are provided for a vehicle truck assembly which includes a spring coupling an axle carrier to a truck frame. In one example, the system comprises a substantially vertically-mounted hydraulic actuator which generates hydraulic forces between the axle carrier and the truck frame. The actuator includes a cylinder, a piston, and a piston rod. Further, the actuator is coupled between the axle carrier and the truck frame with longitudinal and lateral play so that the axle carrier can move laterally and longitudinally with respect to the truck frame while the actuator applies hydraulic force.

20 Claims, 9 Drawing Sheets

U.S. PATENT DOCUMENTS

| | | | | |
|---|---|---|---|---|
| 2009/0095197 | A1* | 4/2009 | Kumar et al. | 105/96 |
| 2009/0099714 | A1* | 4/2009 | Kumar et al. | 701/19 |
| 2010/0175580 | A1* | 7/2010 | Gorski et al. | 105/157.1 |
| 2010/0175581 | A1* | 7/2010 | Kumar et al. | 105/157.1 |
| 2012/0167797 | A1* | 7/2012 | Worden et al. | 105/209 |

FOREIGN PATENT DOCUMENTS

| | | |
|---|---|---|
| FR | 1279890 | 11/1961 |
| FR | 1289653 | 2/1962 |
| FR | 2430880 | 2/1980 |
| GB | 562542 | 7/1944 |
| GB | 1116012 | 6/1968 |
| JP | 2006137238 | 6/2006 |
| RU | 2007316 | 2/1994 |
| SU | 1525056 | 11/1989 |
| WO | 9713653 | 4/1997 |

OTHER PUBLICATIONS

Kumar, Ajith K. et al., "Vehicle Suspension Control System and Method," U.S. Appl. No. 12/574,929, filed Oct. 7, 2009, 56 pages.

* cited by examiner

DYNAMIC WEIGHT MANAGEMENT FOR A VEHICLE VIA HYDRAULIC ACTUATORS

FIELD

The subject matter disclosed herein relates to a hydraulic actuation system coupled to a truck assembly in a vehicle.

BACKGROUND

Vehicles, such as rail vehicles, may be configured with truck assemblies including two trucks per assembly, and three axles per truck. The three axles may include at least one powered axle and at least one non-powered axle. The axles may be connected to the truck frame via a dynamic weight control (DWC) mechanisms (e.g., suspension assemblies including one or more actuators) for adjusting a distribution of vehicle weight (including a vehicle body weight and a vehicle truck weight) between the axles. Weight distribution among the powered and non-powered axles may be performed statically by spring system geometry or stiffness and/or dynamically by adjusting an amount of force exerted by the dynamic weight control mechanisms.

An actuator of the DWC mechanism may adjust a vertical force between the axle and truck. While the mechanism may allow some compliance in the vertical direction, constraints in the lateral and/or longitudinal directions may cause excessively high stresses in components of the truck assembly due to forces generated by dynamic motion of the truck, eccentric loads on the truck, etc.

Additionally, in the example of hydraulic actuation, the actual amount of force may not be directly available from measurements. Further, the amount of force that is provided by the hydraulic actuator may be affected differently by dynamic external factors such as rail irregularities, dynamic coupling force changes, and others, depending on the type of control system.

BRIEF DESCRIPTION OF THE INVENTION

Systems and methods for a hydraulic system for a vehicle truck assembly having a spring coupling an axle carrier to a truck frame are provided. The system may comprise a substantially vertically-mounted hydraulic actuator generating hydraulic forces between the axle carrier and the truck frame. The actuator may be coupled between the axle carrier and the truck frame with longitudinal and lateral play so that the axle carrier can move laterally and longitudinally with respect to the truck frame while the actuator, which includes a cylinder, a piston, and a piston rod, applies hydraulic force in the vertical direction. In this way, it is possible to provide a hydraulic system for dynamic weight management for various vehicle designs which may decrease stress on vehicle components of the truck assembly, for example.

Further, in one embodiment, the hydraulic system is a position control system in which the actuator is mounted such that it is coupled in series with the spring coupling the axle carrier to the truck frame. In this case, the desired axle weight transfer is converted to a desired actuator position, taking into account, operating conditions, so that the axle weight that is exerted on the rail may be accurately controlled.

Further still, in another embodiment, the hydraulic system is a pressure control system in which the actuator is mounted such that it is coupled in parallel with the spring coupling the axle carrier to the truck frame. In this case, the desired axle weight transfer is converted to a desired pressure (for example, without taking into account certain operating conditions) so that the axle weight that is exerted on the rail may be accurately controlled.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The present invention will be better understood from reading the following description of non-limiting embodiments, with reference to the attached drawings, wherein below.

DETAILED DESCRIPTION

Vehicles, such as rail vehicles, including locomotives, may be configured with truck assemblies including suspension systems for transferring weight among wheels and/or axles which support the locomotive. A rail vehicle, such as the locomotive depicted in FIG. 1, may include hydraulic actuators that are coupled to the suspension in order to enable dynamic weight management (DWM), for example. FIG. 2 illustrates hydraulic actuation of a DWC mechanism, such as may be used in the locomotive shown in FIG. 1, for example. Further, a routine that may be used for hydraulic actuation of the DWC mechanism is described with reference FIG. 3. Various hydraulic systems that may be used for DWM are described with reference to FIGS. 4-6. For example, the hydraulic system may be a position control or a pressure control hydraulic system. A pressure control concept for a pressure control hydraulic system is described with reference to a state diagram illustrated in FIG. 7. Finally, hydraulic actuators are described (FIGS. 8-13) which are mounted to the truck assembly in various configurations. For example, some actuators may be coupled to the truck assembly in series with springs of the DWC mechanism while other actuators are coupled to the truck assembly in parallel with springs of the DWC mechanism.

Figure 1:
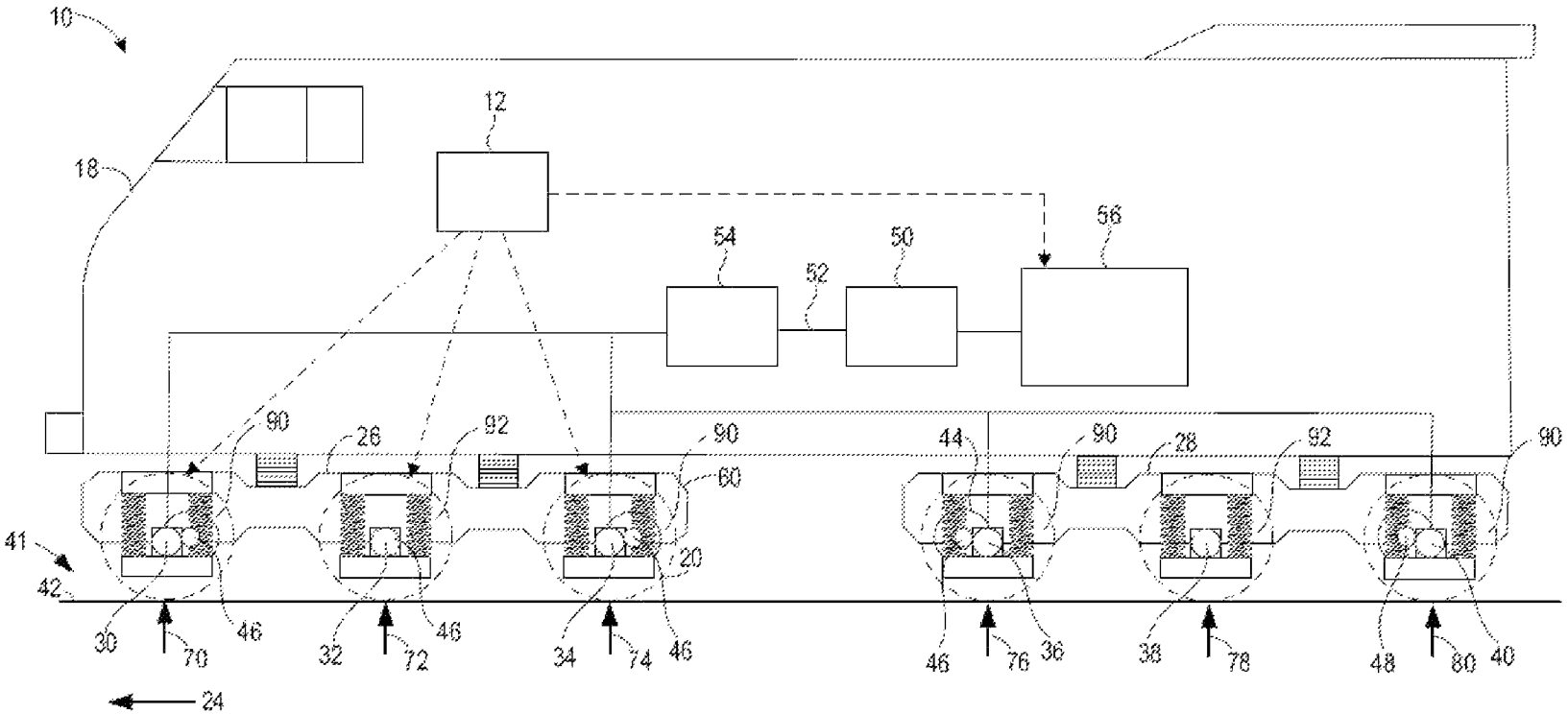
FIG. 1 shows a vehicle comprising a DWC mechanism.
Figure 2:
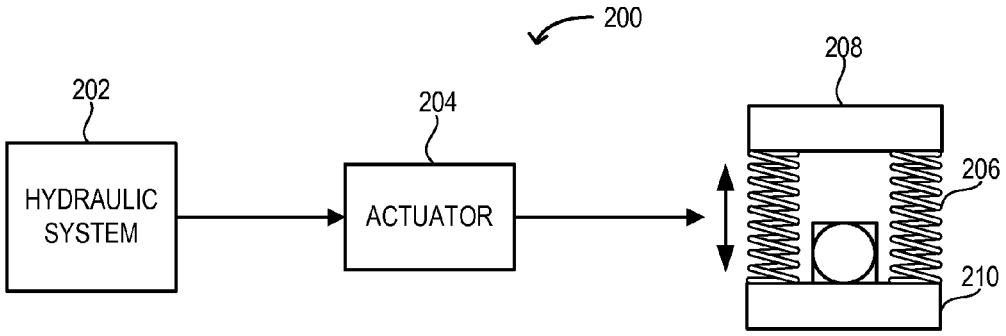
FIG. 2 shows a high level block diagram illustrating a hydraulic actuation of a DWC mechanism.

Referring to FIG. 1, a system 10 including a rail vehicle, such as locomotive 18, is illustrated. However, in alternate examples, the embodiment of system 10 may be utilized with other vehicles, including wheeled vehicles, other rail vehicles, and track vehicles. With reference to FIG. 1, the system 10 is provided for selectively and/or dynamically affecting a normal force 70, 72, 74, 76, 78, 80 applied through one or more of a plurality of locomotive axles 30, 32, 34, 36, 38, 40. The locomotive 18 illustrated in FIG. 1 is configured to travel along a track 41, and includes a plurality of locomotive wheels 20 which are each received by a respective axle 30, 32, 34, 36, 38, 40. Track 41 includes a pair of rails 42. The plurality of wheels 20 received by each axle 30, 32, 34, 36, 38, 40 move along a respective rail 42 of track 41 in a travel direction 24.

As illustrated in the example embodiment of FIG. 1, the locomotive 18 includes a pair of rotatable trucks 26, 28 which are configured to receive a respective plurality of axles 30, 32, 34, and 36, 38, 40. Trucks 26, 28 may include truck frame element 60 configured to provide compliant engagement with carriers (not shown), via a suspension (not shown). The trucks 26, 28 are configured to be rotated, where one or both of the trucks 26, 28 may be rotated 180 degrees from a forward direction, to a rear direction.

Each truck 26, 28 may include a pair of spaced apart powered axles 30, 34, 36, 40 and a non-powered axle 32, 38 positioned between the pair of spaced apart powered axles. The powered axles 30, 34, 36, 40 are each respectively coupled to a traction motor 44 and a gear 46. Although FIG. 1 illustrates a pair of spaced apart powered axles and a non-powered axle positioned there-between within each truck, the trucks 26, 28 may include any number of powered axles and at least one non-powered axle, within any positional arrangement.

Each of the powered axles 30, 34, 36, and 40 include a suspension 90, and each of the non-powered axles 32 and 38 include a suspension 92. The suspensions may include various elastic and/or damping members, such as compression springs, leaf springs, coil springs, etc. In the depicted example, the non-powered axles 32, 38 may include a DWM actuator (not shown) configured to dynamically adjust a compression of the non-powered axle suspensions by exerting an internal compression force. The DWM actuator may be, for example, a pneumatic actuator, a hydraulic actuator, an electromechanical actuator, and/or combinations thereof. A vehicle controller 12 may be configured to activate the DWM actuators in response to an engage command, thereby activating the suspensions of the DWC mechanism and performing dynamic weight management (DWM). By adjusting the compression of the non-powered axle suspensions, weight may be dynamically shifted from the non-powered axle 32 to the powered axles 30, 34 of truck 26. In the same way, dynamic weight shifting can also be carried out in truck 28. As such, it is possible to cause an upward force on the non-powered axles 32, 38 and increase the tractive effort of the locomotive 18 via a corresponding downward force on the powered axles 30, 34, 36, 40. For example, the weight imparted by the powered axles 30, 34 and 36, 40 on the track may be increased, while the weight imparted by the non-powered axles 32, 38 on the track is correspondingly decreased. In an alternative way, an actuator can exert force on non-powered axles to impact dynamic axle weight. A force to separate the powered axles from the truck frame would increase the axle weight.

Returning to FIG. 1, as depicted, in one example, the locomotive is a diesel-electric vehicle operating a diesel engine 56. However, in alternate embodiments of locomotive 18, alternate engine configurations may be employed, such as a gasoline engine or a biodiesel or natural gas engine, for example. Alternatively, the locomotive may be fully electric. A traction motor 44, mounted on a truck 26, 28, may receive electrical power from alternator 50 via DC bus 52 to provide tractive power to propel the locomotive 18. As described herein, traction motor 44 may be an AC motor. Accordingly, an inverter 54 paired with the traction motor may convert the DC input to an appropriate AC input, such as a three-phase AC input, for subsequent use by the traction motor. In alternate embodiments, traction motor 44 may be a DC motor directly employing the output of the alternator after rectification and transmission along the DC bus. One example locomotive configuration includes one inverter/traction motor pair per wheel axle. As depicted herein, 4 inverter-traction motor pairs are shown for each of the powered axles 30, 34 and 36, 40.

Traction motor 44 may act as a generator providing dynamic braking to brake locomotive 18. In particular, during dynamic braking, the traction motor may provide torque in a direction that is opposite from the rolling direction thereby generating electricity that is dissipated as heat by a grid of resistors (not shown) connected to the electrical bus. In one example, the grid includes stacks of resistive elements connected in series directly to the electrical bus. Air brakes (not shown) making use of compressed air may be used by locomotive 18 as part of a vehicle braking system.

As noted above, to increase the traction of driven axles of the truck (by effecting a weight shift dynamically from at least one axle of the truck to at least another axle of the truck), one embodiment uses hydraulically actuated relative displacement between the non-powered axle (e.g., 32 and/or 38) and the truck frame element 60. The relative displacement of the non-powered axle causes a change (e.g., compression) of the axle suspension 92, thus causing a shift of weight to the powered axles (and additional compression of the suspension 90) to compensate for the reduced normal force 72 at the non-powered axle. This action generates an increased normal force 70, 74 on the powered axles 30, 34, for example.

Referring now to FIG. 2, an example embodiment 200 for hydraulic actuation of the DWC mechanism shown in FIG. 1 is illustrated in a high level diagram. As shown, a hydraulic system 202 is in communication with a hydraulic actuator 204. For example, as will be described in further detail below, hydraulic system 202 may be a position control system or a pressure control system. As such, hydraulic system 202 may detect a position of the hydraulic actuator or a pressure on a piston of the hydraulic actuator. Based on a desired amount of force to be applied to a corresponding axle, hydraulic system 202 may adjust an amount of fluid in the actuator. For example, the fluid may be liquid hydraulic fluid such as hydraulic oil. By adjusting the amount of fluid in the actuator, the springs 206 coupling the axle carrier 210 to the truck frame 208 may be compressed or extended thereby raising or lowering the axle.

Figure 3:
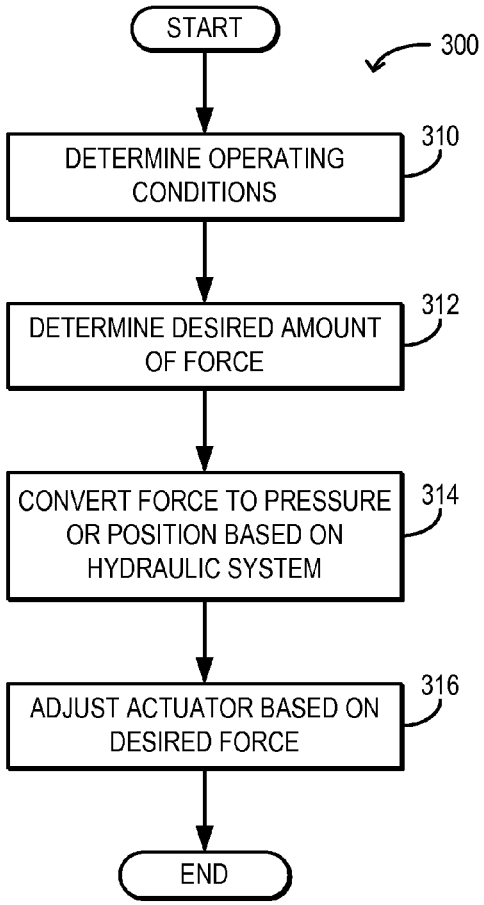
FIG. 3 shows a high level flow chart illustrating a control routine for hydraulic actuation of a DWC mechanism.

FIG. 3 shows a high level flow chart illustrating a control routine 300 for hydraulic actuation of a DWC mechanism, such as for the embodiment shown in FIG. 2. The routine may be performed, for example, by a vehicle controller during vehicle operation to dynamically redistribute the locomotive load between powered and non-powered axles via actuation of one or more hydraulic actuators coupled to the truck assembly.

At 310 of routine 300, vehicle operating conditions are determined. Vehicle operating conditions may include environmental conditions external to the vehicle, such as ambient temperature, pressure, humidity, weather conditions, etc. A rail track condition (or quality of the track on which the vehicle travels) and a geographical input of the location along the rail track may be determined, for example, based on information from a global positioning system (GPS) and/or from a track database. The number of locomotives and cabs in the locomotive consist may be determined. Further still, it may be determined whether the locomotive is in a short hood or long hood direction (e.g., whether the short hood or the long hood is forward in the direction of travel), and a direction of travel may be determined. Other operating conditions of the locomotive which may influence the axle weights include wheel diameter values, fuel level, grade and track cant, friction brake pressures, locomotive speed and tractive effort, wheelslip status and various other operating conditions may also be determined.

Once the operating conditions are determined, routine 300 continues to 312 where a desired amount of force is determined, which may be on a per axle basis, per truck basis, per vehicle basis, or combinations thereof. The desired amount of force may be an amount of hydraulic force needed for each actuator in order to redistribute the locomotive load on the powered and non-powered axles so that the normal force on the powered axles is increased, for example. For example, the desired axle weight that is exerted on the rail may be based on wheel slip, grade, locomotive weight (which varies over time due to fuel storage levels), length of the train, locomotive notch settings, etc.

Once the desired amount of force is determined, routine 300 proceeds to 314 where the force is converted to a value of pressure or position based on the hydraulic system. For example, in a pressure control system, the force is converted to a desired pressure on the piston, while in a position control system, the force is converted to a desired position of the piston. Additionally or alternatively, a desired position of the axle relative to the truck frame may also be determined.

In converting the desired force to a desired position, the routine takes into account external disturbances and loads applied to the truck and axles. For example, at different wheel diameters, different positions may result in the same actuator force. As such, the conversion from the desired engagement to the desired position of the hydraulic system is based not only on the spring rates and other properties of the truck assembly, but also on external factors, such as external loads including grade, dynamic loading, and others. Conversely, in converting the desired force to a desired pressure, the conversion may be insensitive to certain external forces, such as wheel diameter, but may sensitive to other operating conditions. As such, the routine may determine the desire hydraulic pressure independent of external factors, such as due to wheel diameter).

Finally, at 316 of routine 300, the hydraulic actuator is adjusted based on the desired force. For example, in a position control system, a valve may be opened such that an amount of fluid is pumped into the cylinder in order to move the piston to the desired position. In other examples, fluid may be drained from the cylinder in order for the piston to reach the desired position, such as when engagement is no longer desired. As another example, in a pressure control system, an amount of fluid is pumped into or out of the cylinder in order to increase or decrease the pressure in the cylinder.

Figure 4:
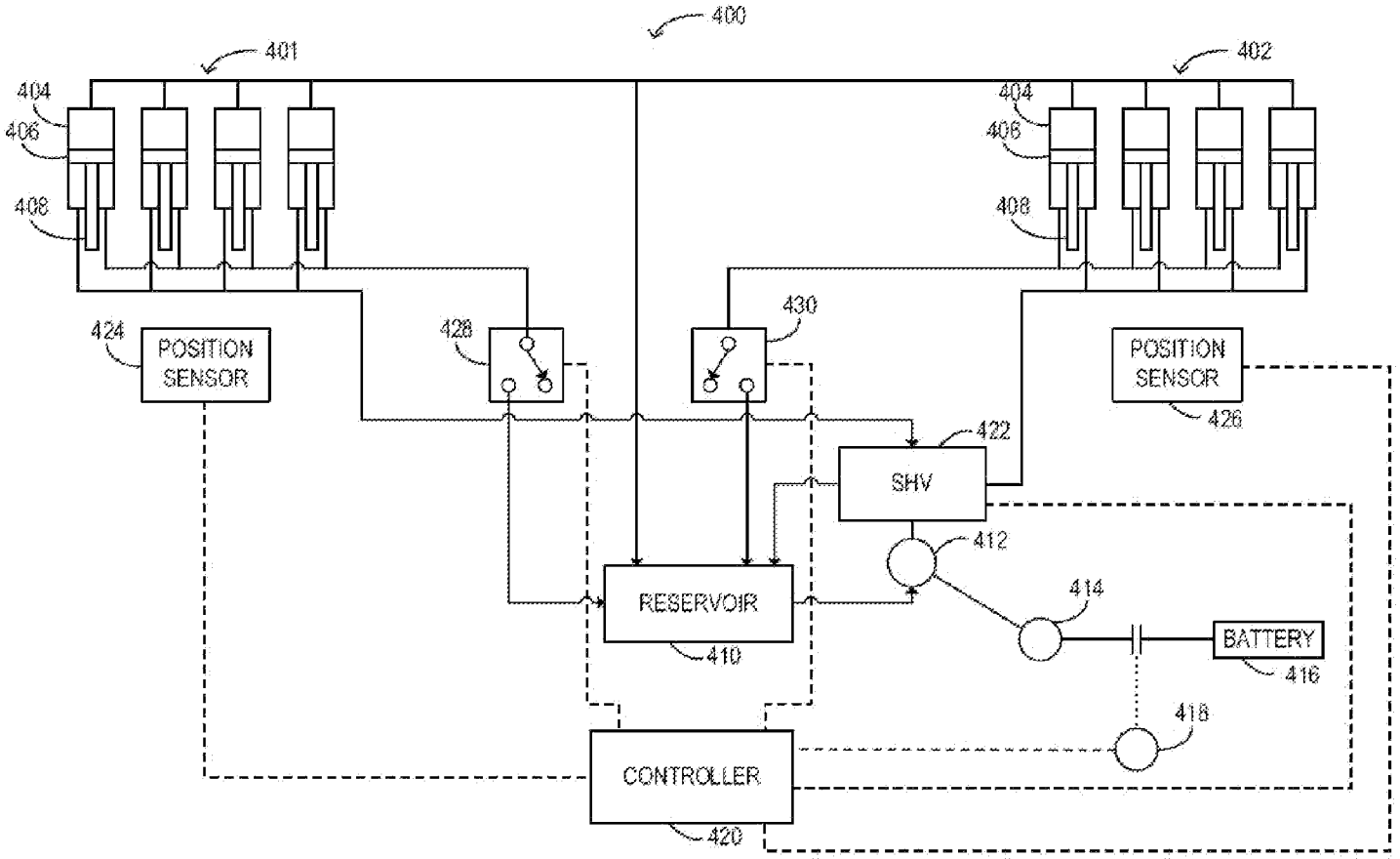
FIG. 4 shows a hydraulic system which includes position control.

Referring to FIG. 4, it shows an example of a hydraulic system 400 which includes a position control system. The position control system may use open loop position control, or closed loop position control based on feedback from position sensors, for example. Based on position information from the position sensors, the position control system may increase or decrease the volume of fluid in each cylinder in order to raise or lower the piston to a desired position thereby applying a desired force to a corresponding axle (e.g., volume control), where the desired position is determined from the desired actuator force and based on the operating conditions of the vehicle truck. As such, the position control system relates position to force.

As shown in the illustrated example, the hydraulic system 400 includes a plurality of hydraulic actuators 401 and 402 coupled to the front truck assembly and the rear truck assembly, respectively. Each of the hydraulic actuators 401 and 402 coupled to the front and rear truck assemblies includes a cylinder 404, a piston 406, and a piston rod 408. Although four hydraulic actuators are shown for each of the front and rear trucks in this example, it should be understood any number of hydraulic actuators may be included in the hydraulic system 400. The hydraulic actuators 401 and 402 may be single acting cylinders (not shown) or double acting cylinders. For example, if the hydraulic actuators are single acting cylinders, the piston rod side of the cylinder may hold the hydraulic fluid that is pumped into the chamber while the other side of the cylinder is filled with air or a spring that is compressed when the piston moves toward it. If the hydraulic cylinders are double acting cylinders (as shown in FIG. 4), both sides of the cylinder may be filled with hydraulic fluid and both sides of the cylinder may drain into a reservoir 410 (e.g., a sump). By using double acting cylinders, piston leaks may be of less consequence. Further, single acting cylinders may act in only one direction (e.g., push or pull) while double acting cylinders may act in two directions (e.g., push and pull). FIG. 4 shows dual ported cylinders which allow the opportunity to supply fresh oil which may flow through the cylinders at least on the high pressure side. When a position controlled hydraulic system is used, such as the hydraulic system 400 shown in FIG. 4, the hydraulic actuators may be coupled to the truck assembly in series with the springs coupling the axle carrier to the truck frame, for example. Examples of such actuators will be described in further detail below with reference to FIG. 8.

Hydraulic fluid (e.g., oil) is pumped from reservoir 410 into the hydraulic actuators 402 via a fixed displacement pump 412 (e.g., a constant flow pump). Fixed displacement pump 412 may be a piston pump, gear pump, etc. which is operated by a DC motor 414. The DC motor is powered by a vehicle battery 416 and power to the motor 414 is controlled via contactor 418 which is in communication with the controller 420, as shown in FIG. 4. The controller 420 may be the vehicle controller 12 described above with reference to FIG. 1. In other examples, the controller 420 may be a microcontroller that is separate from but in communication with the vehicle controller. The controller 420 may include a microprocessor unit, input/output ports, and an electronic storage medium for executable programs and calibration values. For example, the electronic storage medium may be a computer readable medium that includes instructions for adjusting a pressure or volume of the hydraulic fluid in the cylinders.

When in operation, fixed displacement pump 412 supplies a constant flow of hydraulic fluid from the reservoir 410 to a solenoid hydraulic valve (SHV) 422, which is in communication with the controller 420. The controller 420 is further in communication with a plurality of position sensors 424 and 426 coupled to the front truck assembly and rear truck assembly, respectively. One or more position sensors may be coupled to each hydraulic actuator to measure a position of each piston. Additionally or alternatively, one or more position sensors may be coupled to each axle to measure a position of each axle. Based on feedback from the sensors and a desired position of the piston and/or axle, the controller sends a signal to the SHV 422 to direct the flow of fluid from the pump 412 to the actuators coupled to the front truck assembly 401, the actuators coupled to the rear truck assembly 402, and/or the reservoir 410.

For example, if a greater force is desired on an axle in the front truck assembly, the SHV 422 is controlled to direct fluid to flow to the front truck assembly actuators 401. The volume of fluid pumped to the actuators 401 may correspond to the distance the pistons need to move to apply the desired force to the axle. In some examples the SHV 422 may be controlled such that both the front and rear actuators 401 and 402 receive hydraulic fluid based on feedback from the front and rear position sensors 424 and 426. Further, when an increase of fluid volume is not desired in the front or rear hydraulic actuators 401 and 402, the SHV 422 is controlled to direct fluid to the reservoir 410. As such, the pump may continuously pump a constant volume of hydraulic fluid to the SHV 422 and the hydraulic fluid is not always pumped to the hydraulic actuators.

When the DWC of the front or rear axle is no longer desired (e.g., a decrease in force on the axle is desired), front or rear pressure reset valves 428 and 430 are actuated by the controller 420 to drain a desired volume of hydraulic fluid from cylinders to the reservoir 410 where it is collected from both the front and rear hydraulic actuators 428 and 430. The desired volume of hydraulic fluid drained from the cylinders may depend on the desired decrease in force, for example.

Figure 5:
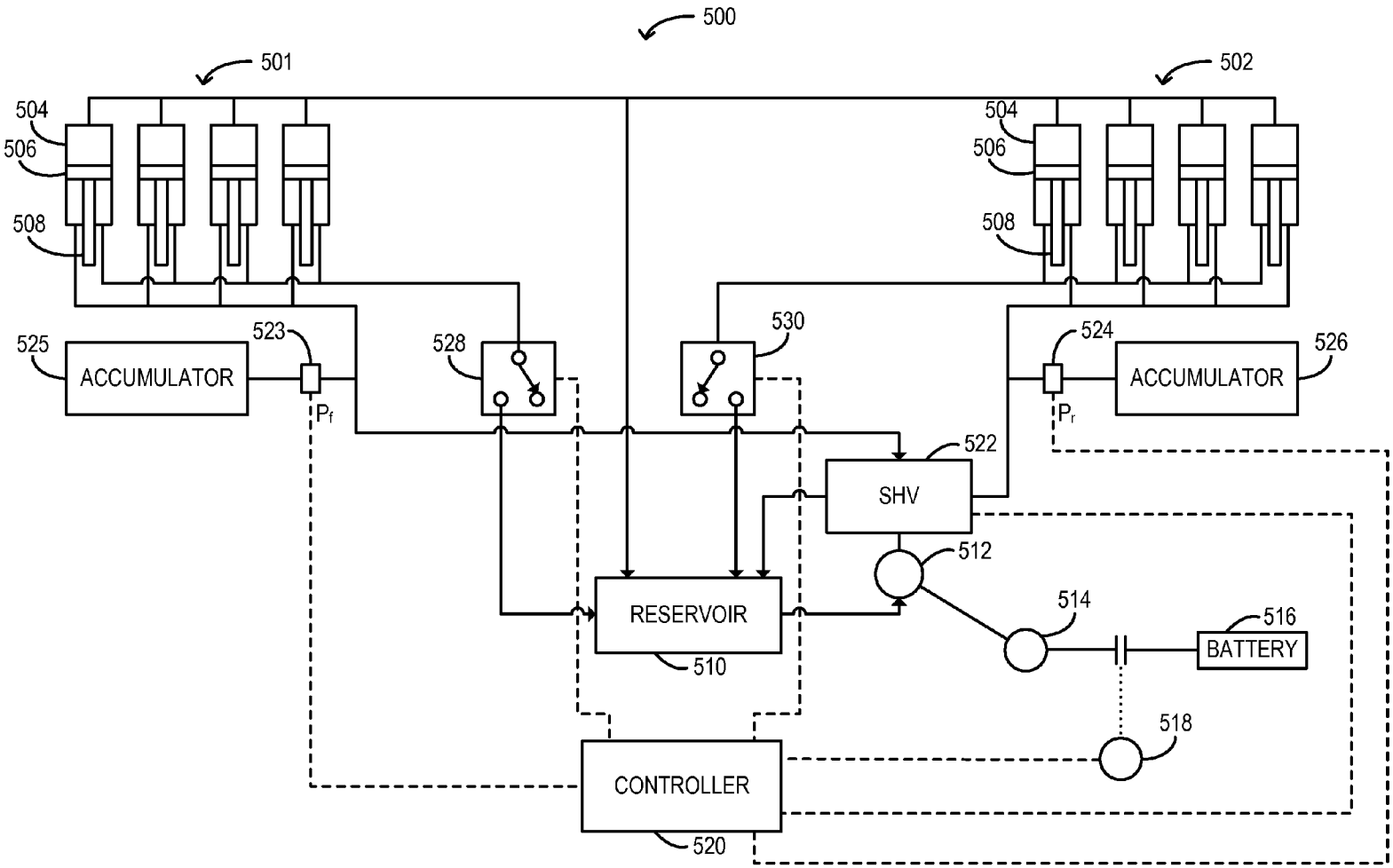
FIG. 5 shows a hydraulic system which includes pressure control and a fixed displacement pump.

FIG. 5 shows another example hydraulic system which includes a pressure control system. The pressure control system may use open loop or closed loop position control based on feedback from pressure sensors, for example. Based on the feedback from the pressure sensors, the pressure control system may increase or decrease the pressure in each cylinder in order to raise or apply a desired force on a corresponding axle. As such, the pressure controls system relates pressure to force.

As shown in the illustrated example of FIG. 5, the hydraulic system 500 includes a plurality of hydraulic actuators 501 and 502 coupled to the front truck assembly and the rear truck assembly, respectively. Each of the hydraulic actuators 501 and 502 coupled to the front and rear truck assemblies includes a cylinder 504, a piston 506, and a piston rod 508. Although four hydraulic actuators are shown for each of the front and rear trucks in this example, it should be understood any number of hydraulic actuators may be included in the hydraulic system 500. The hydraulic actuators 501 and 502 may be single acting cylinders (not shown) or double acting cylinders, as described above. When a pressure controlled hydraulic system is used, such as the hydraulic system 500 shown in FIG. 5, the hydraulic actuators may be coupled to the truck assembly in parallel with the springs coupling the axle carrier to the truck frame, for example. Examples of such actuators will be described in further detail below with reference to FIGS. 9-13.

Similar to the position control hydraulic system 400 described above with reference to FIG. 4, pressure control hydraulic system 500 includes a fixed displacement pump 512 that is operated by a DC motor 514 which is powered by a battery 516 and controlled by a controller 520 via contactor 518. As described above, the controller 520 may be the vehicle controller 12 described above with reference to FIG. 1 or the controller may be a microcontroller that is separate from but in communication with the vehicle controller.

When in operation, fixed displacement pump 512 supplies a constant flow of hydraulic fluid from a reservoir 510 (e.g., a sump) to a solenoid hydraulic valve (SHV) 522, which is in communication with the controller 520. The controller 520 is further in communication with a plurality of pressure sensors 523 that measure a front pressure $P_f$ and pressure sensors 524 that measure a rear pressure $P_r$ coupled to the front truck assembly and rear truck assembly, respectively. For example, one or more pressure sensors may be coupled to each hydraulic actuator to measure a pressure on each piston. In some examples, a single pressure sensor coupled to each of the front and rear assemblies may be used to measure a pressure of the system. Additionally, one or more position sensors may be coupled to each axle to measure a position of each axle. Based on feedback from the pressure sensors and/or a desired position of the axle, the controller sends a signal to the SHV 522 to direct the flow of fluid from the pump 512 to the actuators coupled to the front truck assembly 501, the actuators coupled to the rear truck assembly 502, and/or the reservoir 510.

For example, when a greater pressure is desired in the front truck assembly so that a desired force can be applied to an axle, the SHV 522 is controlled by the controller 520 to allow hydraulic fluid to flow to the front hydraulic actuators 501. Similarly, the SHV 522 may be controlled by the controller 520 to allow hydraulic fluid to flow to the rear hydraulic actuators 502. When additional hydraulic fluid is not desired in the front or rear hydraulic actuators 501 and 502, SHV 522 directs the flow of hydraulic fluid from the pump 512 to the reservoir 510.

Further, the pressure control hydraulic system 500 illustrated in FIG. 5 includes a front accumulator 525 coupled to the front hydraulic actuators 501 and a rear accumulator 526 coupled to the rear hydraulic actuators 502. The accumulators 525 and 526 may be compressed gas accumulators, spring type accumulators, etc. which apply compressive force on the hydraulic fluid and provide compliance for the pressure control hydraulic system 500. For example, the accumulators 525 and 526 may contain a volume of hydraulic fluid that varies in order to maintain a constant pressure in the hydraulic cylinders.

When a decrease in pressure is desired in the front hydraulic actuators 501 (e.g., engagement of the axle is no longer desired), a front pressure reset valve 528 is adjusted by the controller 520 to allow hydraulic fluid from the front hydraulic actuators 501 to flow to the reservoir 510 thereby decreasing the pressure in the front cylinders to the desired pressure. Similarly, when a decrease in pressure in the rear hydraulic actuators 502 is desired, a rear pressure reset valve 530 is adjusted by the controller 520 to allow a desired amount of hydraulic fluid to flow from the rear actuators 502 to the reservoir 510 thereby decreasing the pressure in the rear cylinders to the desired pressure.

Figure 6:
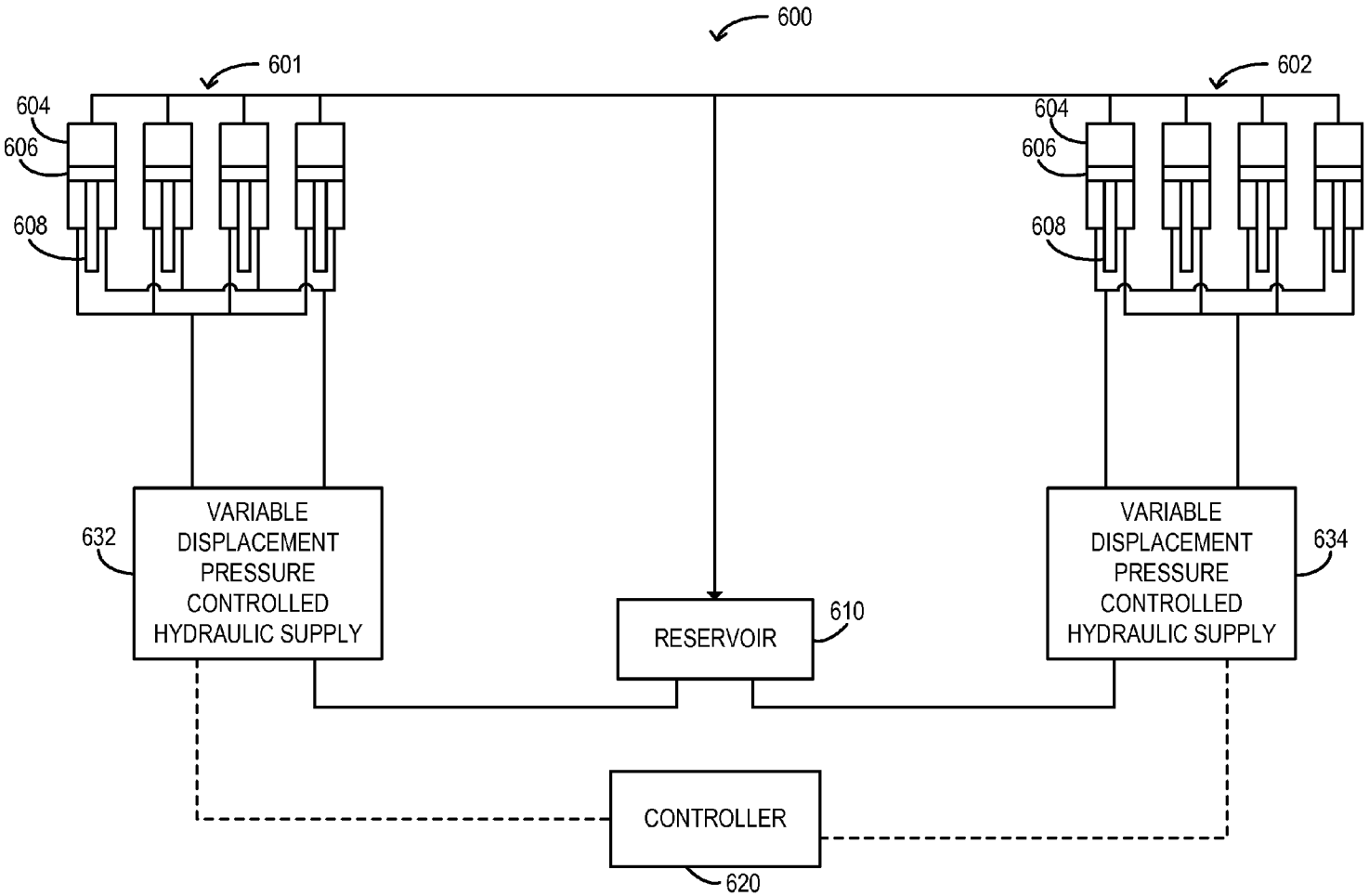
FIG. 6 shows a hydraulic system which includes pressure control and a variable displacement hydraulic supply.

Referring now to FIG. 6, it shows an alternative embodiment of a hydraulic system 600 which includes a pressure control system. Like the hydraulic systems 400 shown in FIG. 4 and 500 shown in FIG. 5, hydraulic system 600 includes a plurality of hydraulic actuators 601 and 602 coupled to the front truck assembly and the rear truck assembly, respectively. Each of the hydraulic actuators 601 and 602 coupled to the front and rear truck assemblies includes a cylinder 604, a piston 606, and a piston rod 608. Although four hydraulic actuators are shown for each of the front and rear trucks in this example, it should be understood any number of hydraulic actuators may be included in the hydraulic system 600. The hydraulic actuators 601 and 602 may be single acting cylinders (not shown) or double acting cylinders where hydraulic fluid from either side of the cylinders may be drained to a reservoir 610, as described above. When a pressure controlled hydraulic system is used, such as the hydraulic system 600 shown in FIG. 6, the hydraulic actuators may be coupled to the truck assembly in parallel with the springs coupling the axle carrier to the truck frame, for example, as will be described in further detail below with reference to FIGS. 9-13.

In contrast to the pressure control hydraulic system 500 illustrated in FIG. 5, hydraulic system 600 includes front and rear variable displacement pressure controlled hydraulic supplies 632 and 634 which are in communication with a controller 620. As stated above, controller 620 may be the vehicle controller 12 described with reference to FIG. 1 or may be a separate controller from vehicle controller 12 that is in communication with vehicle controller 12. As an example, variable displacement pressure controlled hydraulic supplies 632 and 634 may each include a control orifice, a pressure compensator, and a variable displacement pump. For example, the variable displacement pump may supply a variable flow of hydraulic fluid to the actuators while the pressure compensator and control orifice may act to maintain a desired pressure in the cylinders. Thus, the pump supplies a desired amount of fluid to the hydraulic actuators while the pressure in each of the cylinders is maintained at a desired pressure by the pressure compensator and control orifice.

Figure 7:
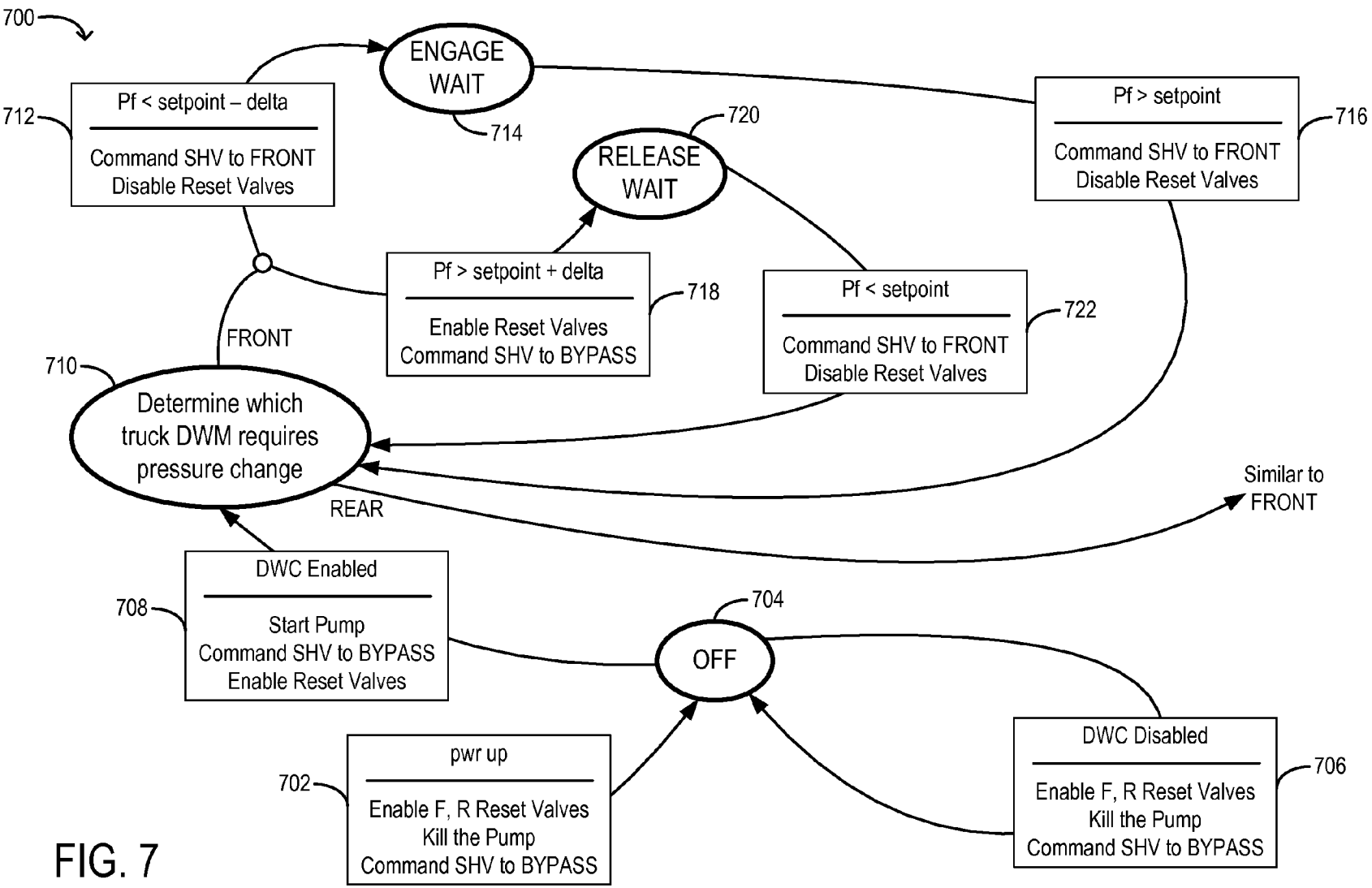
FIG. 7 shows an example state diagram for controlling pressure

Continuing to FIG. 7, an example state diagram 700 is shown to illustrate the pressure control concept of a hydraulic system when a fixed displacement pump and accumulator is used along with actuators in parallel with the primary suspension springs of a non-powered axle. For example, state diagram 700 may be used with the hydraulic system 500 illustrated in FIG. 5. State diagram 700 may be used by the controller to determine whether engagement of an axle should be initiated or maintained.

At 702, power to the system is turned on (e.g., pwr up), for example, the vehicle may be started. Here, the front and rear pressure reset valves are enabled. Further, the controller commands the solenoid hydraulic valve (SHV) to bypass. For example, the SHV is adjusted such that flow from the pump flows to a reservoir and not the front or rear hydraulic actuators. Further, power to the pump is turned off (e.g., kill the pump) and the system transitions to an OFF state at 704.

During the off state, the system may transition at 706 such that DWC is disabled. For example, the front and rear pressure reset valves are enabled thereby draining hydraulic fluid from the front and rear actuators. Further, the pump is turned off (e.g., kill the pump) and the controller commands the SHV to bypass, as described above. As such, any hydraulic fluid inside the actuators is drained and hydraulic fluid does not flow to the hydraulic actuators; thus, the actuators may not be used to engage the axles via dynamic weight management (DWM).

At 708, the system transitions from the OFF state and DWC is enabled. Here, the pump may be started. For example, the controller may send a signal to the contactor to switch power to the motor on and the pump starts. Further, the controller commands the SHV to bypass and the reset valves are enabled. In such a configuration, the hydraulic system is ready to provide force to the axles in the truck assembly, but hydraulic fluid is not yet flowing to the hydraulic actuators and, therefore, no force is provided by the actuators.

From 708, the system transitions to a state 710 in which it is determined which truck requires pressure change via DWM. For example, in this state, the axles may be in an engaged position in which weight is shifted to the powered axles from the non-powered axles, or the axles may be in an unengaged position in which weight has not been redistributed. Which truck requires pressure change may be based on a speed of the vehicle, weather conditions, track condition, etc. The following examples will be described with respect to the front truck. In the case in which the rear truck requires pressure change, a similar routine may be carried out.

In response to a condition in which the front pressure (e.g., pressure in the cylinders of the front truck) is less than a setpoint minus a delta valve (e.g., $P_f$<setpoint−delta) at 712, the system transitions to an ENGAGE WAIT state at 714 in which the non-powered axle is engaged (pressure is sent to the DWC actuator), for example. At 712, the controller commands the SHV to adjust such that the front actuators receive hydraulic fluid from the pump. Further, the pressure reset valves are disabled. In this manner, the hydraulic actuators may fill with fluid until a desired pressure in the cylinders is reached corresponding to a hydraulic force which engages the non-powered axle to a desired height.

From the ENGAGE WAIT state 714 in which engagement is maintained, the system transitions back to 710 where it is determined which truck requires pressure change via 716. At 716, the system is in a condition in which the front pressure is greater than a setpoint (e.g., $P_f$>setpoint). In this condition, the controller commands the SHV to the front and the pressure reset valves are disabled. As such, the hydraulic actuators may continue to receive hydraulic fluid in order to maintain the engaged position of the non-powered axle, for example.

In response to a condition in which the front pressure is greater than a setpoint plus a delta value (e.g., $P_f$>setpoint+delta), the system transitions to a RELEASE WAIT state at 720. For example, at 710, the pressure reset valves may be enabled and the controller commands the SHV to bypass. Thus, hydraulic fluid in the actuators is drained and hydraulic fluid is not pumped to the actuators. In this manner, the hydraulic force on the non-powered axle may be reduced thereby reducing the amount of force the non-powered axle receives.

From the RELEASE WAIT state 720, the system may transition back to the state at 710 where it is determined which truck requires a pressure change. For example, the system may transition from 720 back to 710 in response to a condition in which the front pressure is less than a setpoint (e.g., $P_f$<setpoint) at 722. For example, at 722, operating conditions may cause the pressure to change in the actuators and the controller commands the SHV to front and the pressure reset valves are disabled. As such, hydraulic fluid is pumped into the actuators and the pressure may increase.

Turning to FIGS. 8-13, hydraulic actuators coupled to truck assemblies via various mounting configurations are illustrated. The hydraulic actuators may be used with the position control and pressure control hydraulic systems described above as well as with the state diagram described with reference to FIG. 7.

Figure 8:
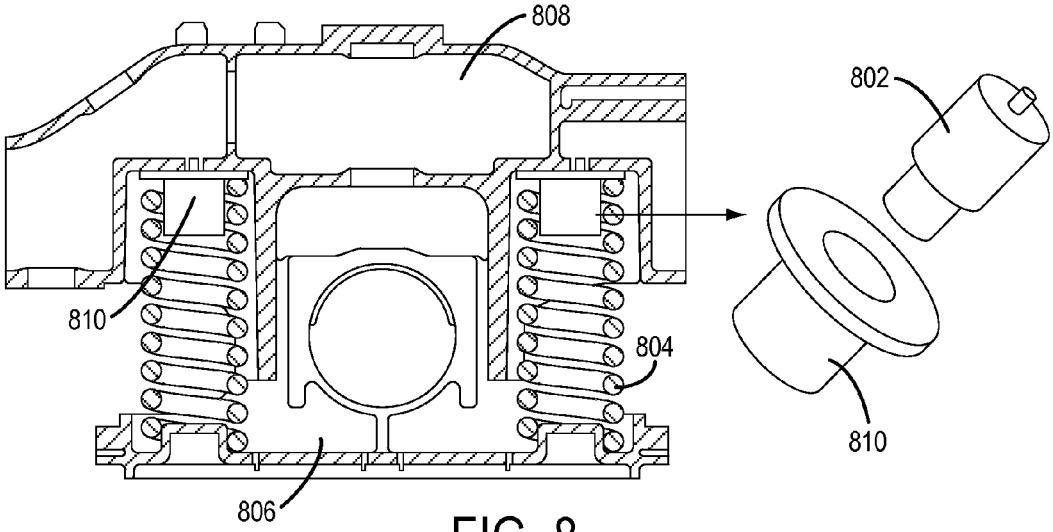
FIG. 8 shows an example of a hydraulic cylinder mounted in series with springs.

FIG. 8 shows an example of a hydraulic actuator 802 coupled in series with the springs 804 coupling an axle carrier 806 to a truck frame 808. The hydraulic actuator 802 may be used with a hydraulic system that includes position control such as the position control hydraulic system 400 illustrated in FIG. 4.

As illustrated in FIG. 8, the hydraulic actuator 802 is mounted substantially vertically in an inverted hat-shaped chamber 810 that is in direct contact with the springs 804 such that the cylinder end of the actuator 802 is coupled to the truck frame and the piston rod end of the of the actuator 802 is in coupled to the chamber 810. It should be understood that "substantially vertically" as used herein implies vertically plus or minus one degree to account for manufacturing variances. A hydraulic actuator may be mounted in each of the springs coupling each of the powered axle carriers to the truck frame. As such, the vehicle illustrated in FIG. 1 and described above may have sixteen actuators in total (e.g., four per powered axle and four powered axles per locomotive). In such a configuration, the hydraulic actuator may apply a force such that it pushes the truck frame 808 away from the axle carrier 806. Thus, the non-powered axle coil spring force of compression would be less than that of the powered axles.

Figure 9:
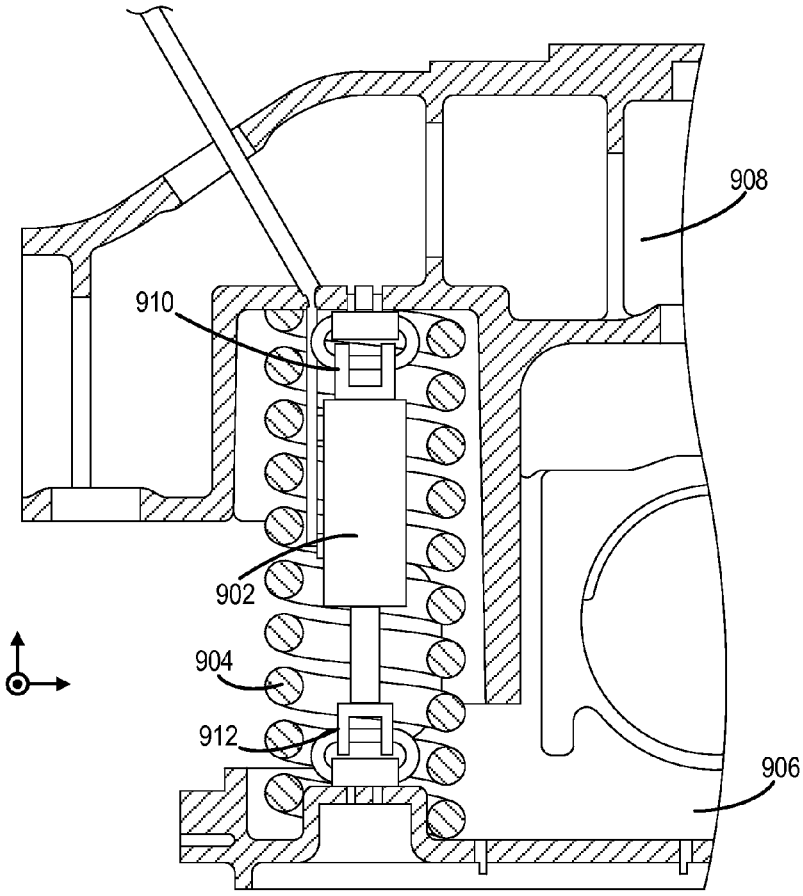
FIG. 9 shows an example of a hydraulic actuator mounted in parallel with springs.

Referring to FIG. 9, an example of a hydraulic actuator 902 coupled in parallel with the springs 904 coupling an axle carrier 906 to a truck frame 908 in a two degrees of freedom mount is illustrated. The hydraulic actuator 902 may be included in a hydraulic system that uses pressure control such as hydraulic system 500 of FIG. 5 or hydraulic system 600 of FIG. 6, for example.

As illustrated in FIG. 9, the hydraulic actuator 902 is mounted substantially vertically between the axle carrier 906 and the truck frame 908 inside of the spring 904. The cylinder end of the actuator 902 includes a clevis 910 which is coupled to the truck frame 908. Similarly, the piston rod end of the actuator 902 includes a clevis 912 which is coupled to the axle carrier. In such a configuration, the actuator 902 has play (e.g., tolerance) in the lateral (e.g., in and out of the page) and longitudinal (e.g., in the left and right directions of the page) directions at both the cylinder end of the actuator 902 and the piston rod end of the actuator 902 in addition to movement in the vertical direction (e.g., in the up and down direction of the page). For example, in response to the motion of the vehicle (e.g., curving), the piston rod end of the actuator 902 may move, with the axle bearing housing, either laterally or longitudinally with respect to the truck frame.

In some examples, the hydraulic actuators 902 may be coupled between non-powered axles and the truck frame. As such, a vehicle such as locomotive 18 illustrated in FIG. 1 may have 8 hydraulic actuators in total (e.g., four hydraulic actuators per non-powered axle, two non-powered axles per locomotive). Further, when the actuators are coupled to non-powered axles in a two degrees of freedom mount, the actuators 902 apply a hydraulic force on the axles by pulling the axle carries 906 (and thus the axles) toward the truck frame 908. In this way, the weight on the axles is redistributed as the non-powered axles are pulled to a position that is closer to the truck frame than the original static position of all axles. Since both sets of coil springs, 90 and 92, have to experience the same deflection under this scenario, more of the truck weight is carried by the springs, 90, on the powered axles (30,34,36, 40). This results in higher normal force on the rail under the powered axles enabling increased traction between the locomotive and the rails of the track, for example.

In other examples, the hydraulic actuator 902 may be coupled between powered axles and the truck frame. Thus, a vehicle such as locomotive 18 illustrated in FIG. 1 may have sixteen hydraulic actuators in total (e.g., four hydraulic actuators per powered axle, four powered axles per locomotive). In such a configuration, the actuators 902 apply a force by pushing the truck frame 908 away from the axle carrier 906. In this way, the weight of the axles may be redistributed as the non-powered axle coil spring, 92, deflection has to match the deflection of powered axle coil springs, 90, resulting in less of the total truck weight being carried by the non-powered axles (32, 38) and more of the weight being carried by the powered axles (30,34, 36, 40).

Figure 10:
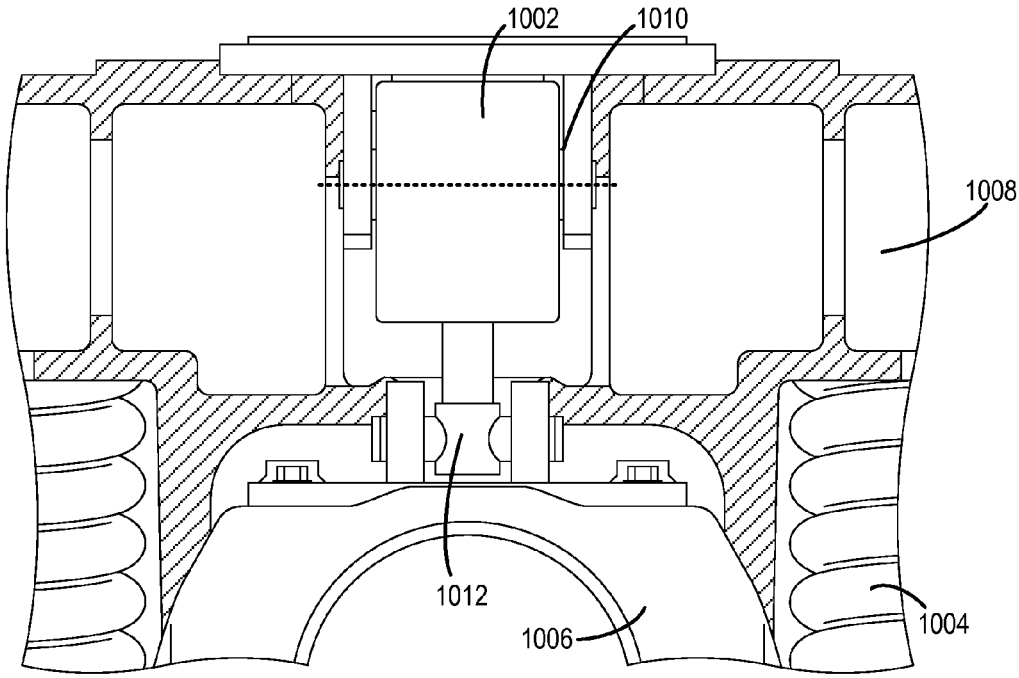
FIG. 10 shows an example of a hydraulic actuator in a trunnion mount.

As another example of a hydraulic actuator coupled to a truck assembly, FIG. 10 shows an example of a hydraulic actuator 1002 coupled in parallel with the springs 1004 coupling an axle carrier 1006 to a truck frame 1008 in a trunnion mount. The hydraulic actuator 1002 may be included in a hydraulic system that uses pressure control, for example, such as hydraulic system 500 illustrated in FIG. 5 or hydraulic system 600 illustrated in FIG. 6.

Figure 11:
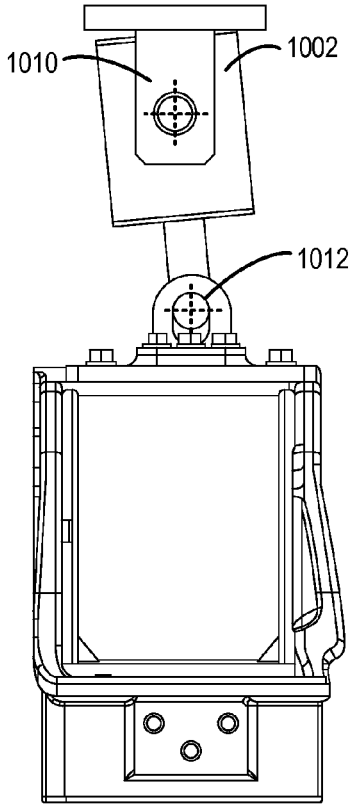
FIG. 11 shows an example of a side view of hydraulic actuator in a trunnion mount.

As illustrated in FIG. 10, the actuator 1002 is coupled substantially vertically between an axle carrier 1006 and a truck frame 1008. In the illustrated embodiment, the cylinder end of the actuator 1002 is coupled to the truck frame 1008 via a trunnion 1010 and the piston rod end of the actuator is coupled to the axle carrier 1006 via a pin and eye mount 1012. In this example, the trunnion 1010 allows the hydraulic actuator 1002 to rotate about a longitudinal axis (e.g., lateral play) which indicated by a dashed line in FIG. 10. For example, the actuator 1002 may move ±1 inch in the lateral direction (e.g., into or out of the page). FIG. 11 shows a side view of the hydraulic actuator 1002 shown in FIG. 10 in which the hydraulic actuator 1002 is pivoted in the lateral direction away from the truck frame 1008 (e.g., toward the right side of the page in FIG. 11). Further, pin and eye mount 1012 allows the actuator to move slightly in the longitudinal direction (e.g., longitudinal play). For example, the actuator may move ±0.25 inches in the longitudinal direction (e.g., toward the left or right sides of the page). Thus, the trunnion mount 1010 may account for relatively large lateral axle motion while there is limited tolerance to longitudinal motion.

Further, an actuator in a trunnion mount, such as actuator 1002 shown in FIGS. 10 and 11, may be mounted to the non-powered axles of the vehicle. As such, a vehicle such as the locomotive 18 illustrated in FIG. 1 may have four hydraulic actuators in total (e.g., two hydraulic actuators per non-powered axle, two non-powered axles per locomotive). In such a configuration, the load on the axles may be dynamically redistributed as the actuators 1002 apply a hydraulic force by pulling the axle carrier (and thus the corresponding axle) toward the truck frame and away from the rails of the track.

Figure 12:
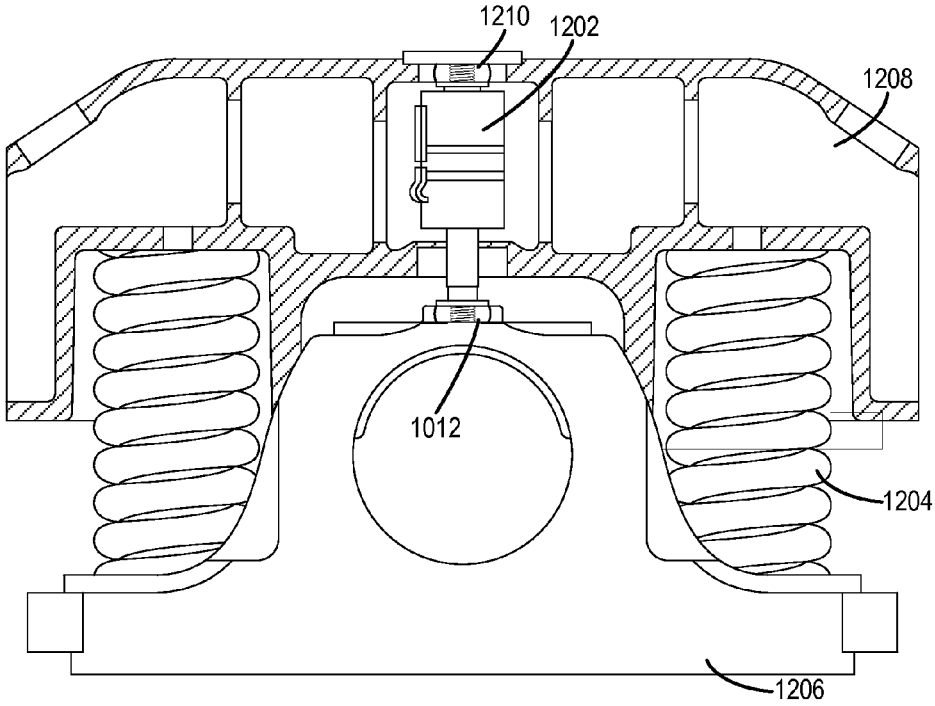
FIG. 12 shows an example of a hydraulic actuator in a ball and socket mount.

Continuing to FIG. 12, an example of a hydraulic actuator 1202 coupled in parallel with the springs 1204 between an axle carrier 1206 and truck frame 1208 in a ball and socket mount is illustrated. The hydraulic actuator 902 may be included in a hydraulic system that uses pressure control such as hydraulic system 500 illustrated in FIG. 5 or hydraulic system 600 illustrated in FIG. 6, for example.

As shown in the example of FIG. 12, the actuator 1202 is coupled substantially vertically between the axle carrier 1206 and the truck frame 1208. In this example, the each end of the actuator is coupled to the truck assembly via a ball and socket mount 1210 and 1212. Each ball and socket mount includes a ball portion which is coupled to the actuator and a socket portion that is part of the truck assembly. As such, the ball and socket mounts 1210 and 1212 may be machined into the truck assembly, for example. The ball and socket mount on the cylinder end 1210 and the ball and socket mount on the piston rod end 1212 provide the hydraulic actuator 1202 with longitudinal and lateral play so that the axle carrier 1206 can move laterally and longitudinally with respect to the truck frame 1208 while the actuator 1202 applies hydraulic force.

The actuator 1202 mounted in a ball and socket mount as illustrated in FIG. 12 may be coupled to non-powered axles of the vehicle. As such, a vehicle such as locomotive 18 shown in FIG. 1 may have four hydraulic actuators which act to pull the axle carrier toward the truck frame. Since both sets of coil springs, 90 and 92, have to experience the same deflection under this scenario, more of the truck weight is carried by the springs, 90, on the powered axles (30,34,36,40). This results in higher normal force on the rail under the powered axles which enables increased traction between the locomotive and the rails of the track, for example. In other examples, the actuator may be mounted in a ball and socket mount inside the springs coupling the axle carrier to the truck frame (as the actuator 920 depicted in FIG. 9), for example. Could be mounted inside springs (like two degrees of freedom mount.

Figure 13:
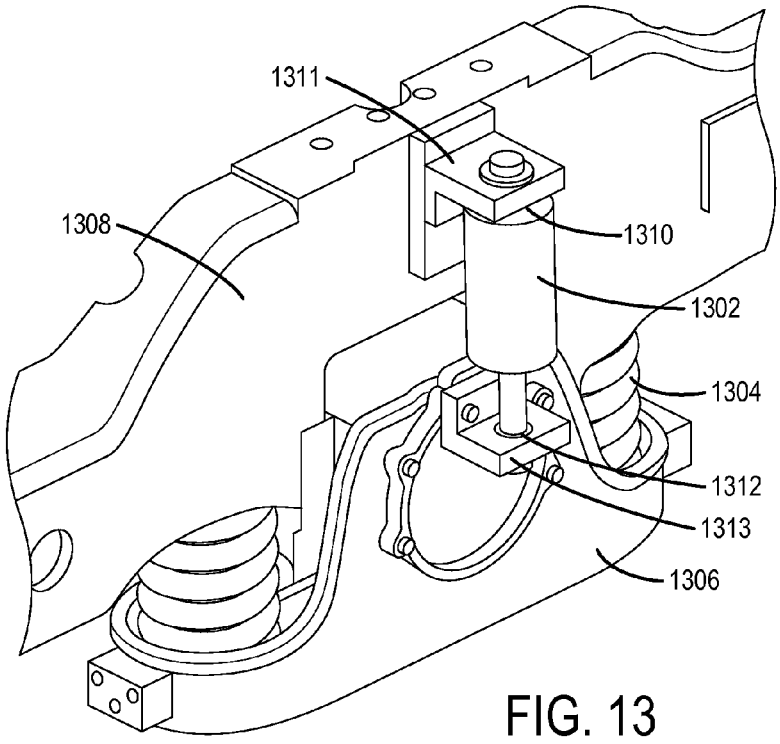
FIG. 13 shows an example of a hydraulic actuator in a ball and socket mount.

Another example of a hydraulic actuator 1302 mounted substantially vertically in a ball and socket mount is illustrated in FIG. 13. In this example, the actuator is coupled between an outside portion of an axle carrier 1306 and an outside portion of a truck frame 1308 in parallel with the springs 1304. In such an embodiment, the ball and socket mounts 1310 and 1312 may be machined inside brackets 1311 and 1313, respectively, which couple the actuator 1302 to the truck assembly.

It should be understood that each of the mounting configurations described above with reference to FIGS. 8-13 may be used alone or in combination with another mounting configuration on a vehicle. For example, actuators coupled in series with the springs coupling an axle carrier to a truck frame may be used with actuators in a trunnion mount. Further, a front truck assembly may have hydraulic actuators mounted in a different configuration than the rear truck assembly.

As described above, hydraulic actuators may be coupled to a truck assembly of a vehicle in a various configurations. As such, dynamic weight management may be carried in various configurations out based on the design of a particular vehicle, for example, while decreasing stress on locomotive components such as the brake linkage or the wheels and axles.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A system, comprising:

a vehicle truck assembly, the vehicle truck assembly including a first spring coupling a first axle carrier to a truck frame and a second spring coupling a second axle carrier to the truck frame;

a hydraulic system including a substantially vertically-mounted hydraulic actuator generating hydraulic forces between the first axle carrier and the truck frame, the actuator coupled between the first axle carrier and the truck frame with longitudinal and lateral play so that the first axle carrier can move laterally and longitudinally with respect to the truck frame while the actuator applies hydraulic force, the actuator including a cylinder, a piston, and a piston rod, the actuator hydraulically coupled in a hydraulic circuit including a pump and controlled with a pressure control system adjusting pressure responsive to system sensors.

2. The system of claim 1, wherein the hydraulic actuator is mounted in parallel with the first spring, and wherein each end of the hydraulic actuator includes a clevis mount for mounting a cylinder end of the hydraulic actuator to the truck frame and a piston rod end of the hydraulic actuator to the first axle carrier.

3. The system of claim 1, wherein the hydraulic actuator is mounted in parallel with the first spring, and wherein a cylinder end of the hydraulic actuator is coupled to the truck frame via a ball and socket mount and a piston rod end of the hydraulic actuator is coupled to the first axle carrier via a ball and socket mount.

4. The system of claim 1, wherein the pressure control system includes a pressure sensor, an accumulator, and a controller in communication with the pressure sensor, the controller comprising instructions to adjust a pressure of a fluid in the cylinders based on a desired force to be applied to a corresponding axle.

5. A hydraulic system for a vehicle truck assembly, the vehicle truck assembly including a spring coupling an axle carrier to a truck frame, comprising:

a substantially vertically-mounted hydraulic actuator generating hydraulic forces between the axle carrier and the truck frame, the actuator coupled between the axle carrier and the truck frame with longitudinal and lateral play so that the axle carrier can move laterally and longitudinally with respect to the truck frame while the actuator applies hydraulic force, the actuator including a cylinder, a piston, and a piston rod; and a position control system which includes an accumulator with open loop volume control, and a controller in communication with the accumulator, the controller comprising instructions to adjust a volume of fluid in the accumulator based on a desired position of the hydraulic actuator, the desired position based on a desired amount of engagement.

6. The hydraulic system of claim 5, wherein the hydraulic actuators are coupled to springs coupling axle carriers which hold powered axles to the truck frame.

7. The hydraulic system of claim 5, wherein the position sensors indicate a position of each piston.

8. The hydraulic system of claim 5, wherein the position sensors indicate a position of each axle.

9. A hydraulic system for a vehicle truck assembly, the vehicle truck assembly including springs coupling an axle carrier to a truck frame, comprising:

a plurality of hydraulic actuators coupled in series with the springs of the truck assembly, each actuator including a cylinder, a piston, and a piston rod;

a pump;

a plurality of position sensors; and a controller in communication with the position sensors, the controller comprising a computer readable storage medium, the medium including instructions for adjusting a volume of fluid in each cylinder to move each piston to a predetermined position based on a desired force to be applied to a corresponding axle and based on an external load applied to the truck assembly.

10. The hydraulic system of claim 9, further comprising a solenoid hydraulic valve which directs a flow of the fluid from the pump to increase the volume of fluid in the cylinders and to a fluid reservoir, the fluid reservoir collecting fluid from the hydraulic actuators and supplying fluid to the pump, and wherein the external load includes grade.

11. The hydraulic system of claim 9, wherein the pump is a fixed displacement pump.

12. The hydraulic system of claim 9, further comprising a pressure reset valve to reduce the volume of fluid in each cylinder.

13. A hydraulic system for a vehicle truck assembly, the vehicle truck assembly including springs coupling an axle carrier to a truck frame, comprising:

a plurality of hydraulic actuators coupled in parallel with the springs of the truck assembly, each actuator including a cylinder, a piston, and a piston rod;

a pump;

a plurality of pressure sensors; and a controller in communication with the pressure sensors, the controller comprising a computer readable storage medium, the medium including instructions thereon for adjusting a pressure of a fluid in the cylinders based on a desired force to be applied to a corresponding axle.

14. The hydraulic system of claim 13, further comprising a compressed gas accumulator, and wherein the pump is a fixed displacement pump that supplies the fluid to the compressed gas accumulator and the cylinders.

15. The hydraulic system of claim 14, further comprising a solenoid hydraulic valve which directs a flow of the fluid from the pump to the hydraulic actuators and to a fluid reservoir, the fluid reservoir supplying fluid to the pump and collecting fluid from the hydraulic actuators.

16. The hydraulic system of claim 13, further comprising a variable displacement pressure controlled fluid supply including a pressure compensator and a control orifice, and wherein the pump is a variable displacement pump.

17. The hydraulic system of claim 13, wherein a cylinder end of each actuator is mounted to the truck frame in a trunnion mount and a piston rod end of each actuator is mounted to the axle carrier in a pin eye mount so that the axle carrier can move laterally and longitudinally with respect to the truck frame while the actuators apply hydraulic force, and wherein the actuators are coupled between the truck frame and axle carrier of non-powered axles.

18. The hydraulic system of claim 13, wherein the actuators are mounted in a two degrees of freedom mount in which each end of the actuator is mounted to the truck frame and to the axle carrier via a clevis so that the axle carrier can move laterally and longitudinally with respect to the truck frame while the actuators apply hydraulic force, and wherein the actuators are coupled to at least one of an axle carrier that holds a non-powered axle and an axle carrier that holds a powered axle.

19. The hydraulic system of claim 13, wherein the actuators are mounted in a ball and socket mount in which the actuator is coupled between the truck frame and the axle carrier via a ball and socket on each end of the actuator so that the axle carrier can move laterally and longitudinally with respect to the truck frame while the actuators apply hydraulic force.

20. The hydraulic system of claim 13, wherein the actuators are mounted in a ball and socket mount in which the actuator is coupled between an outside portion of the truck frame and an outside portion of the axle carrier via a ball and socket on each end of the actuator.

* * * * *